US012667232B2

(12) United States Patent
Chen et al.

(10) Patent No.: US 12,667,232 B2
(45) Date of Patent: Jun. 30, 2026

(54) ROTATABLE DUAL-PURPOSE AXIAL-FLOW BLOWER/VACUUM

(71) Applicant: JINGYAN MECHANICAL & ELECTRICAL TOOLS CO., LTD, JINHUA, Jinhua (CN)

(72) Inventors: Huabin Chen, Jinhua (CN); Yanqing Chen, Jinhua (CN)

(73) Assignee: JINGYAN MECHANICAL & ELECTRICAL TOOLS CO., LTD, JINHUA, Jinhua (CN)

( * ) Notice: Subject to any disclaimer, the term of this patent is extended or adjusted under 35 U.S.C. 154(b) by 337 days.

(21) Appl. No.: 18/387,864

(22) Filed: Nov. 8, 2023

(65) Prior Publication Data

US 2024/0065496 A1 Feb. 29, 2024

Related U.S. Application Data

(63) Continuation of application No. PCT/CN2022/079627, filed on Mar. 7, 2022.

(30) Foreign Application Priority Data

Feb. 21, 2022 (CN) ..... 202210155260.0

(51) Int. Cl.

| | |
|---|---|
| ***A47L 5/24*** | (2006.01) |
| ***A47L 5/14*** | (2006.01) |
| ***A47L 9/32*** | (2006.01) |

(52) U.S. Cl.

CPC ..... *A47L 5/14* (2013.01); *A47L 5/24* (2013.01); *A47L 9/322* (2013.01)

(58) Field of Classification Search

CPC ..... A47L 5/24; A47L 5/28; A47L 5/14; A47L 9/322

See application file for complete search history.

(56) References Cited

U.S. PATENT DOCUMENTS 5,938,410 A 8/1999 Lee
6,108,863 A * 8/2000 Lin ..... A47L 9/08 15/346

(Continued)

FOREIGN PATENT DOCUMENTS

CN 101135139 A 3/2008
CN 205676815 U 11/2016

(Continued)

OTHER PUBLICATIONS

European search report of EP22926354.6.
International Search Report of PCT/CN2022/079627.

*Primary Examiner* — Michael D Jennings

(57) ABSTRACT

A rotatable dual-purpose axial-flow blower/vacuum is provided, including a main machine housing and an airflow driving device provided in the main machine housing, an air suction transition joint being provided on one end of the main machine housing, and an air blowing portion being provided on the other end, and further including a handle connected to the main machine housing, a switch for controlling start or stop of blowing/suction being provided on the handle. When a rotation locking structure is pressed, the main machine housing can be rotated to enable the air suction transition joint to face forwards, and the axial-flow blower/vacuum is configured to be in a dust collection mode; and the main machine housing is rotated to enable the air blowing portion to face forwards, and the axial-flow blower/vacuum is configured to be in an air blowing mode.

5 Claims, 7 Drawing Sheets

(56) References Cited

U.S. PATENT DOCUMENTS

| | | | | |
|---|---|---|---|---|
| D451,521 | S | 12/2001 | Poon | |
| D943,636 | S | 2/2022 | Beard et al. | |
| 2017/0296006 | A1* | 10/2017 | Wang | A47L 9/0063 |
| 2018/0310786 | A1* | 11/2018 | Zhong | A47L 5/26 |
| 2020/0296904 | A1 | 9/2020 | Yu et al. | |

FOREIGN PATENT DOCUMENTS

| | | | |
|---|---|---|---|
| CN | 107653823 | A | 2/2018 |
| CN | 207244526 | U | 4/2018 |
| CN | 110644402 | A | 1/2020 |
| CN | 210228009 | U | 4/2020 |
| JP | 2001149278 | A | 6/2001 |

* cited by examiner

ROTATABLE DUAL-PURPOSE AXIAL-FLOW BLOWER/VACUUM

CROSS-REFERENCE TO RELATED APPLICATIONS

This application is a continuation of international patent application No. PCT/CN2022/079627, filed on Mar. 7, 2022, which itself claims priority to Chinese patent application No. 202210155260.0, filed on Feb. 21, 2022, titled "ROTATABLE DUAL-PURPOSE AXIAL-FLOW BLOWER/VACUUM", which is hereby incorporated by reference.

TECHNICAL FIELD

The present disclosure relates to a field of electric tools, and in particular, to a rotatable dual-purpose axial-flow blower/vacuum.

BACKGROUND

A blower/vacuum usually has two purposes, and can be used as an air blower for cleaning fallen leaf, dust and the like in outdoor environments such as courtyards and roads. At the same time, after a filter net and a dust box are installed, it can be used as a small dust collector to clean dust and garbage in an indoor environment.

In an existed blowing and sucking machine in the market, a centrifugal fan is mainly used, and a direction of an air suction port and a direction of an air outlet are perpendicular to each other. Only under either of a working state of dust collection and a working state of an air blowing, a handle is easy for an operator to grasp. Furthermore, for an axial-flow blower/vacuum, a direction of airflow is a straight line, and a design of the handle can only facilitate the use of either of dust collection mode and air blowing mode.

SUMMARY

For solving the above problem, it is necessary to provide a rotatable dual-purpose axial-flow blower/vacuum. By rotating a direction of a main machine housing, two working modes of dust collection and air blowing can be achieved, a rotation direction of fan blades does not need to be converted, and a control circuit is simplified. Furthermore, in the two working modes, an ergonomic design of the handle can be met, so that a use convenience of the rotatable dual-purpose axial-flow blower/vacuum can be maximized.

To achieve the above objectives, technical solutions provided by the present disclosure are as follows. A rotatable dual-purpose axial-flow blower/vacuum is provided, which includes a main machine housing and an airflow driving device in the main machine housing. An air suction transition joint is provided on one end of the main machine housing. An air blowing portion is provided on the other end of the main machine housing. A dust accumulation box is detachably connected to the air suction transition joint. An air suction portion is detachably connected to the air suction transition joint. An air blowing bent pipe is detachably connected to the air blowing portion. The air suction transition joint is connected to either the dust accumulation box or the air suction portion. A dust filter net is provided in the dust accumulation box. The rotatable dual-purpose axial-flow blower/vacuum further includes a handle connected to the main machine housing. A bottom of the handle is provided with a battery mounting base for mounting a battery pack. A switch for controlling start or stop of blowing/suction is provided on the handle. A rotation structure is provided between the main machine housing and the handle and configured to realize a rotation between the main machine housing and the handle. The rotation structure is provided with a rotation locking structure. The rotation locking structure is configured to lock a circumferential position between the main machine housing and the handle. When the rotation locking structure is pressed, the main machine housing is capable to be rotated to enable the air suction transition joint to face forwards and the air blowing portion to face backward, the dust accumulation box is capable to be mounted to the air suction transition joint, the air blowing bent pipe is capable to be mounted to the air blowing portion, and the axial-flow blower/vacuum is capable to be set in a dust collection mode. When the rotation locking structure is pressed, the main machine housing is capable to be rotated to enable the air blowing portion to face forwards and the air suction transition joint to face backward, the air suction portion is capable to be mounted to the air suction transition joint, and the axial-flow blower/vacuum is capable to be set in an air blowing mode.

In some embodiments, the rotation structure includes a handle top plate arranged at a top of the handle and a machine housing bottom plate arranged at a bottom of the main machine housing. A rotation shaft is arranged in a center of the handle top plate. A rotation shaft shoulder is arranged at a tail end of the rotation shaft. A rotation shaft sleeve is arranged on the machine housing bottom plate and matched with the rotation shaft to rotate, and an inner diameter of the rotation shaft sleeve is greater than an outer diameter of the rotation shaft and less than an outer diameter of the rotation shaft shoulder.

In some embodiments, a limiting boss is arranged on the rotation shaft shoulder. A first limiting stop block and a second limiting stop block are symmetrically arranged on the rotation shaft sleeve and matched with the limiting boss to limit a maximum rotation angle of the main machine housing to be 180 degrees. When the limiting boss is located at a position of the first limiting stop block, the air suction transition joint faces forwards, and the axial-flow blower/vacuum is capable to be set in the dust collection mode. When the limiting boss is located at a position of the second limiting stop block, the air blowing portion faces forwards, and the axial-flow blower/vacuum is capable to be set in the air blowing mode.

In some embodiments, the rotation locking structure includes a rotation locking connection rod and a reset elastic member arranged at a rear of the rotation locking connection rod. The rotation locking connection rod is arranged below the handle top plate in a front-back direction of the handle. Two self-locking bosses are arranged at a front position and a rear position of an upper surface of the rotation locking connection rod. Two self-locking openings are formed in the handle top plate. Two arc-shaped rotating grooves are formed in the machine housing bottom plate by taking the rotating shaft sleeve as a center. The self-locking bosses are clamped into the rotating grooves through the self-locking openings. A self-locking bayonet is arranged at a central position of the rotating groove. And under an action of the reset elastic member, the self-locking boss is capable to be clamped into the self-locking bayonet to limit a rotation of the main machine housing.

In some embodiments, the air blowing bent pipe is rotatable.

Advantages of the rotatable dual-purpose axial-flow blower/vacuum in the present invention are as follows: 1) the main machine housing can be capable to be rotated without changing a handheld mode, achieving switching of a dust collection mode and an air blowing mode, and meeting an ergonomic design of the handle, and it is convenient for use; and 2) a rotating direction of the fan blades does not be required to be converted, achieving a dual-purpose of a dust collection function and an air blowing function, simplifying a control circuit, and reducing the cost.

In the figures, 1 represents a main machine housing; 1*a* represents a rotation locking structure; 1*b* represents a rotation structure; 2 represents a handle; 3 represents an airflow driving device; 4 represents a battery mounting base; 5 represents a battery pack; 6 represents an air suction transition joint; 7 represents an air blowing portion; 8 represents an air blowing bent pipe; 9 represents a switch; 10 represents a rotation locking connection rod; 11 represents a self-locking boss; 12 represents a reset elastic member; 13 represents a dust accumulation box; 14 represents a dust filter net; 15 represents an air suction portion; 16 represents a handle top plate; 17 represents a machine housing bottom plate; 18 represents a rotation shaft; 19 represents a rotation shaft shoulder; 20 represents a limiting boss; 21 represents a rotation shaft sleeve; 22 represents a first limiting stop block; 23 represents a second limiting stop block; 24 represents a self-locking bayonet; and 25 represents a rotating groove.

DETAILED DESCRIPTION OF THE EMBODIMENT

Embodiments of the Present Disclosure

For a better understanding of the patent, preferred embodiments of the invention are described in detail in conjunction with the attached drawings. It should be understood by those skilled in the art that these exemplary embodiments do not imply any limitation on the form of the present invention. Rather, these embodiments are provided for the purpose of providing a more thorough understanding of the disclosure of the invention.

Figure 1:
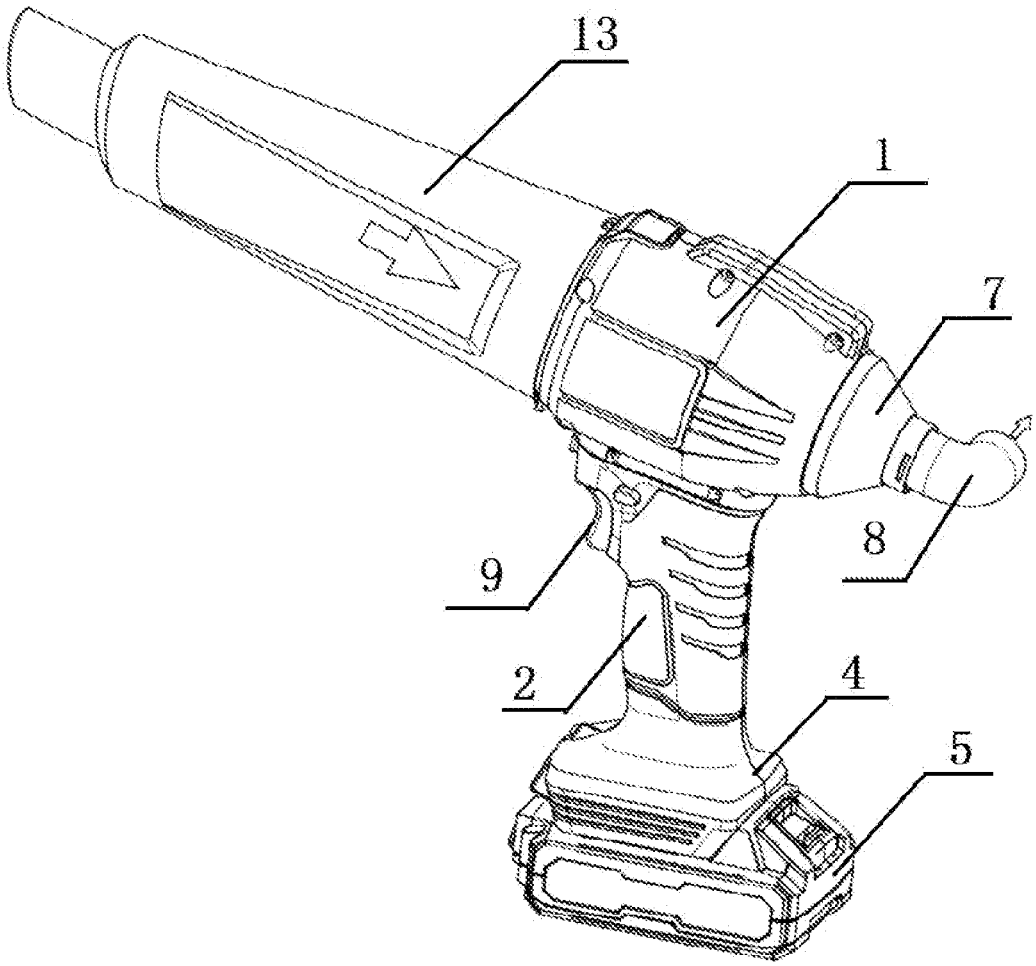
FIG. 1 is a schematic view of a rotatable dual-purpose axial-flow blower/vacuum in a dust collection mode in an embodiment of the present disclosure.
Figure 2:
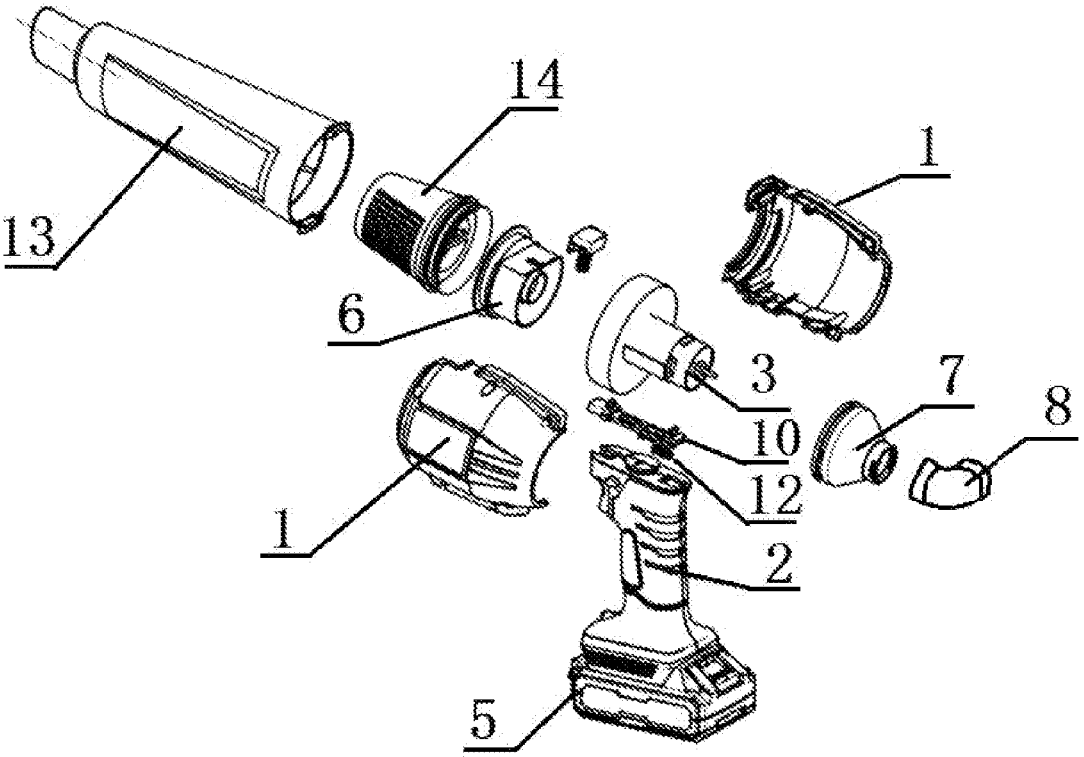
FIG. 2 is an explosive view of a rotatable dual-purpose axial-flow blower/vacuum in a dust collection mode in an embodiment of the present disclosure.
Figure 3:
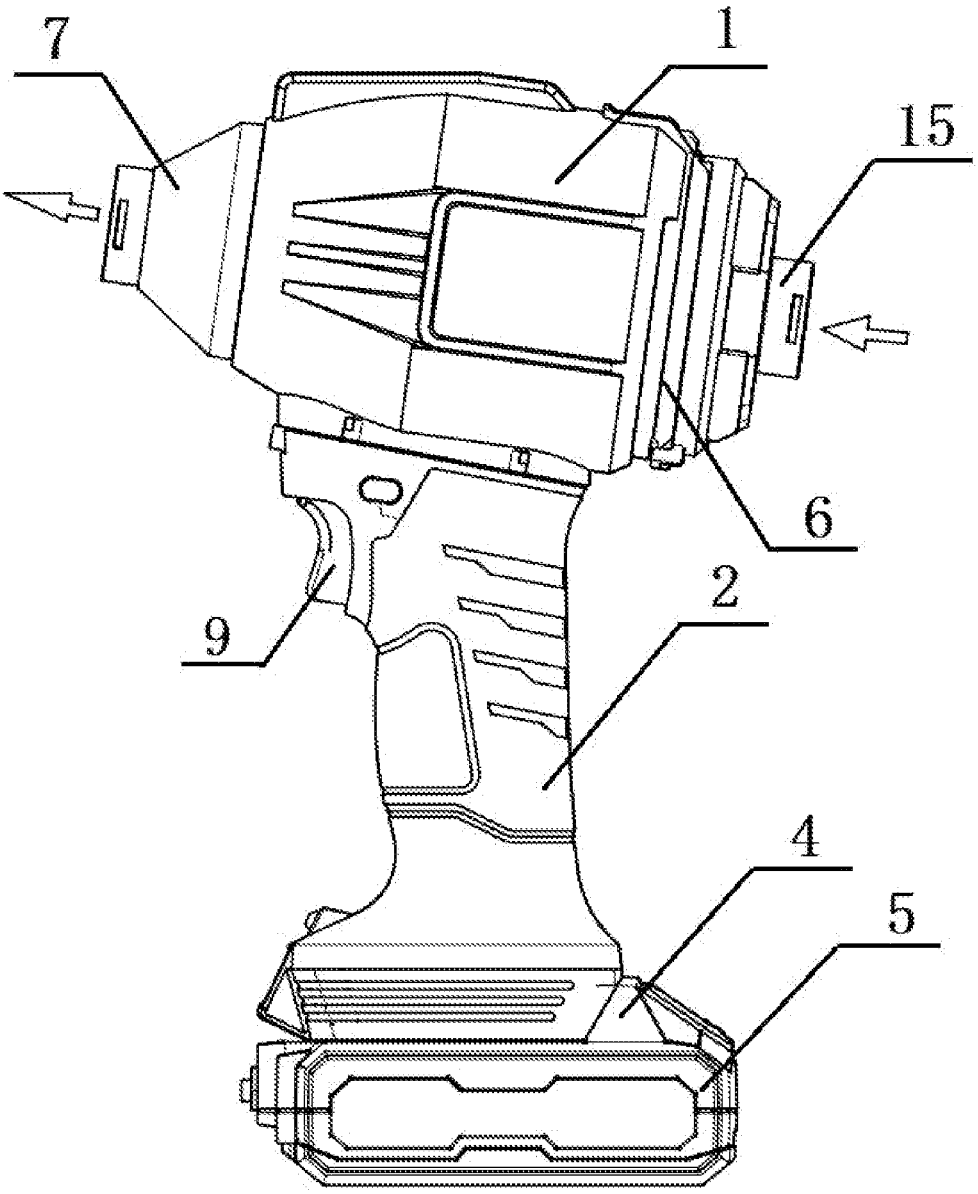
FIG. 3 is a schematic view of a rotatable dual-purpose axial-flow blower/vacuum in an air blowing mode in an embodiment of the present disclosure.
Figure 4:
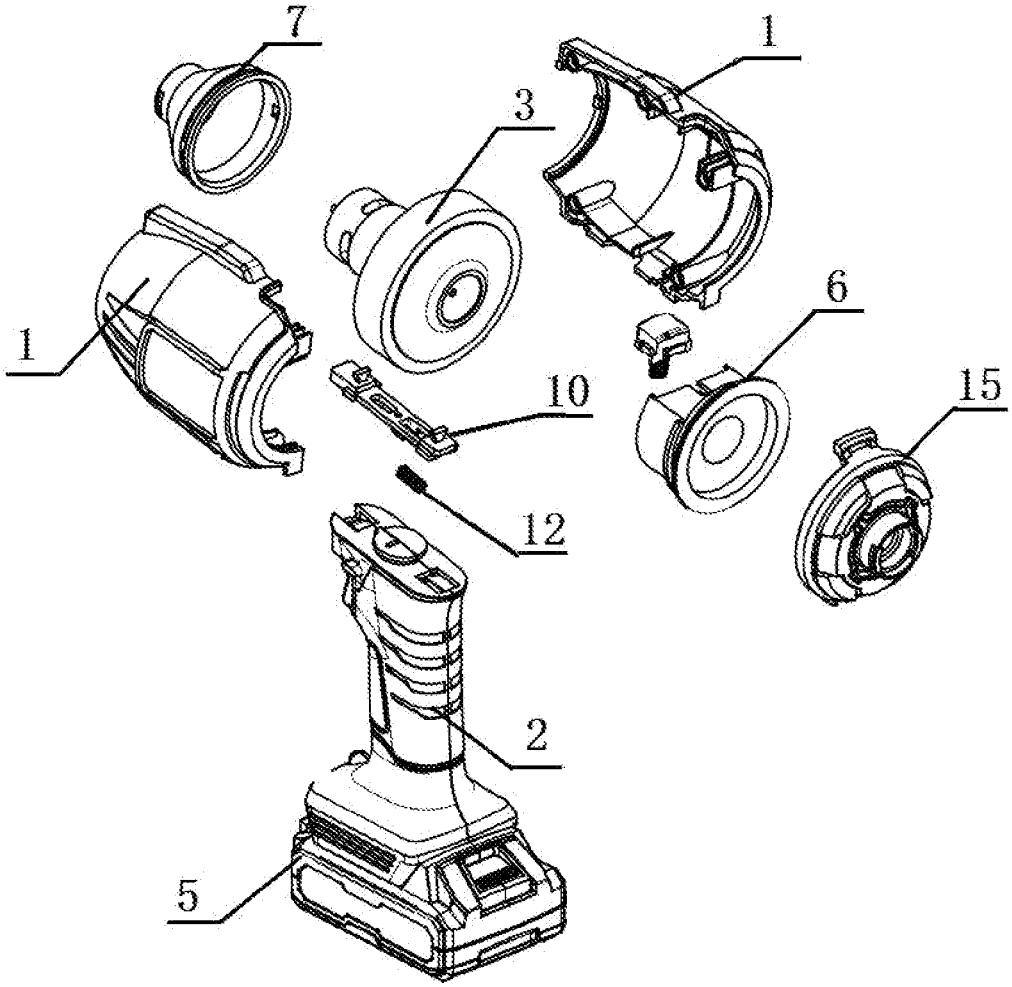
FIG. 4 is an explosive view of a rotatable dual-purpose axial-flow blower/vacuum in an air blowing in an embodiment of the present disclosure.
Figure 5:
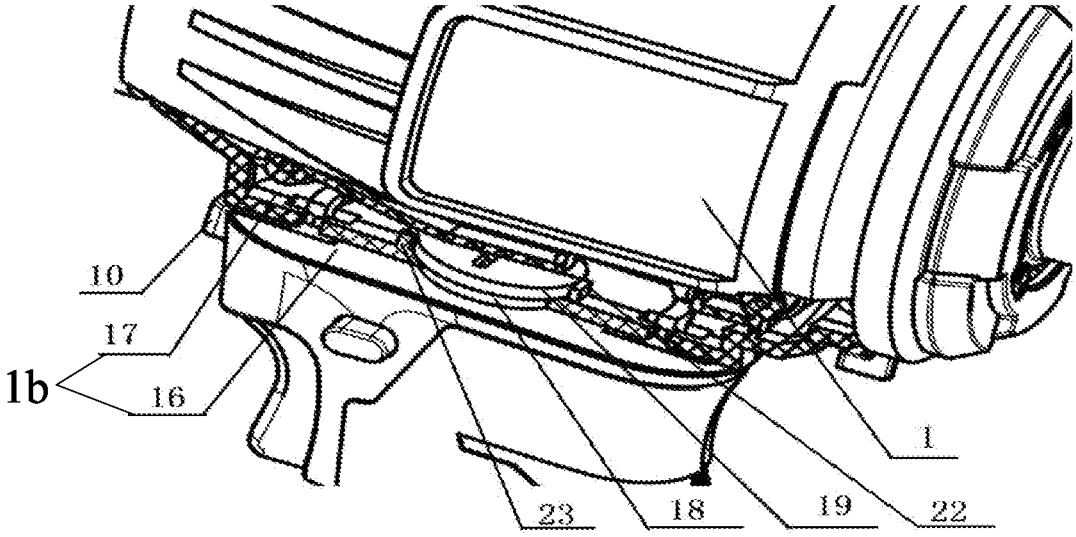
FIG. 5 is a schematic view of a rotation structure of a rotatable dual-purpose axial-flow blower/vacuum in an embodiment of the present disclosure.
Figure 6:
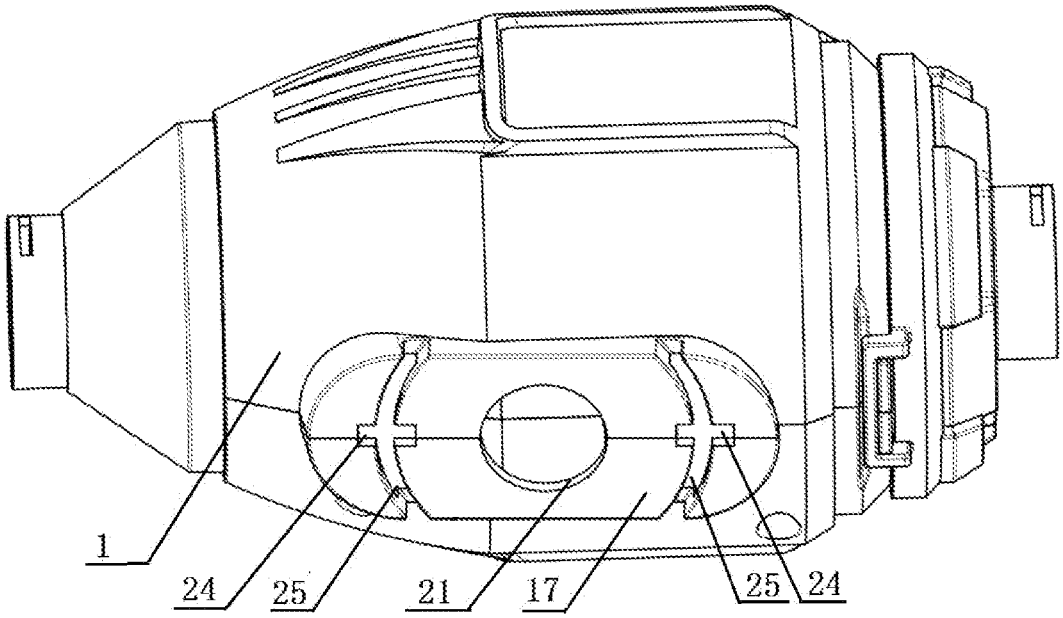
FIG. 6 is a schematic view of a machine housing bottom plate of a rotatable dual-purpose axial-flow blower/vacuum in an embodiment of the present disclosure
Figure 7:
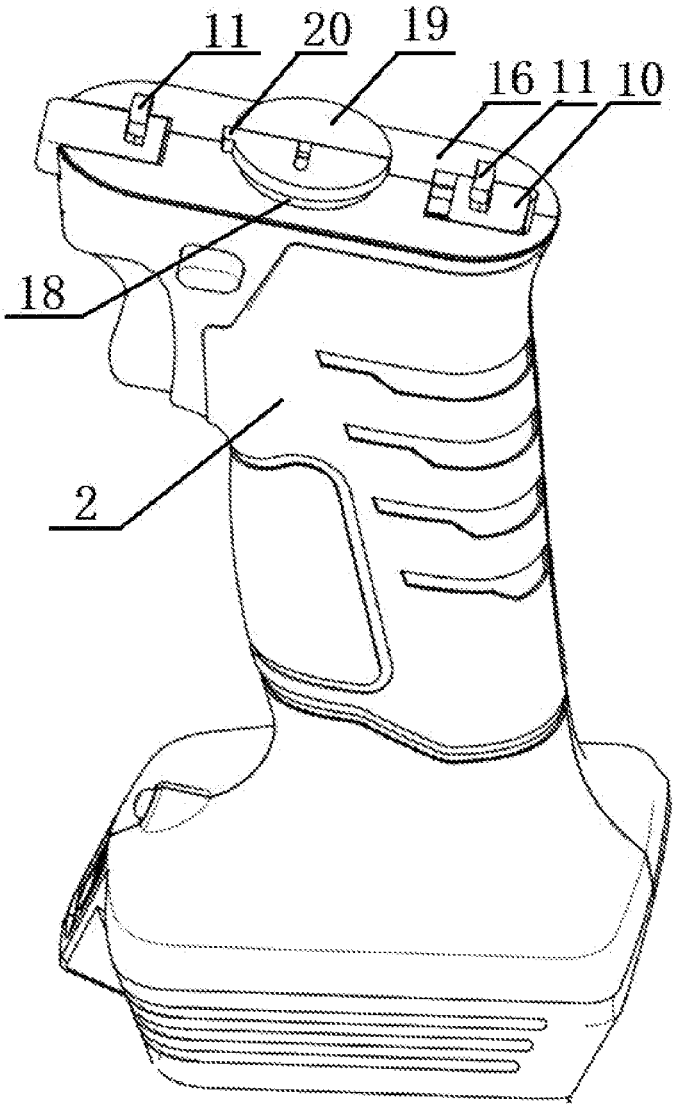
FIG. 7 is a schematic view of a handle top plate of a rotatable dual-purpose axial-flow blower/vacuum in an embodiment of the present disclosure.
Figure 8:
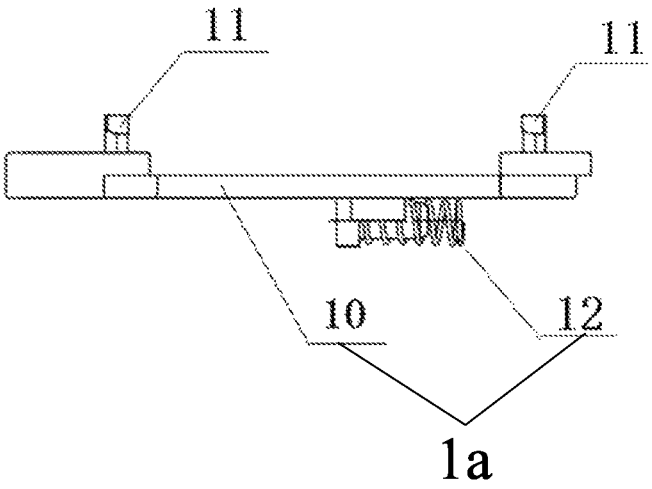
FIG. 8 is a schematic view of a rotation locking connection rod of a rotatable dual-purpose axial-flow blower/vacuum in an embodiment of the present disclosure.
Figure 9:
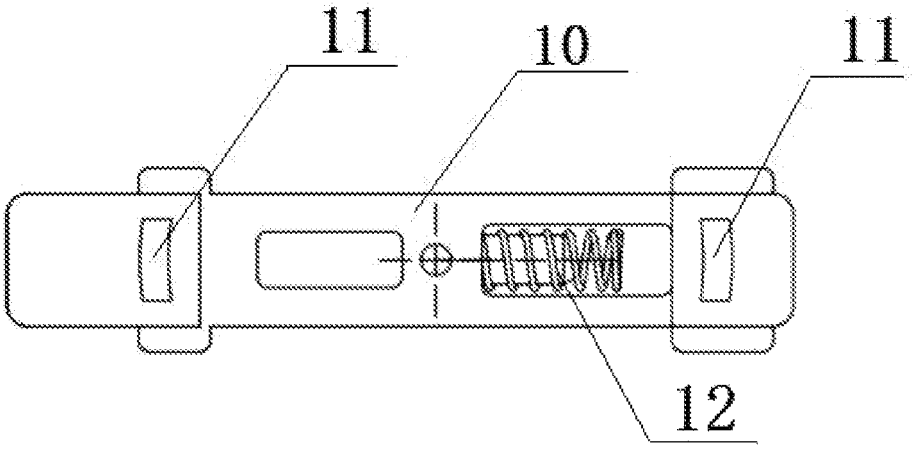
FIG. 9 is a top view of a rotation locking connection rod of a rotatable dual-purpose axial-flow blower/vacuum in an embodiment of the present disclosure.

Referring to FIG. 1 to FIG. 9, an embodiment of the present disclosure provides a rotatable dual-purpose axial-flow blower/vacuum, including a main machine housing 1 and an airflow driving device 3 in the main machine housing 1. The main machine housing 1 can play a role in accommodating and protecting other components. The airflow driving device 3 is configured for generating an air flow, for example, the airflow driving device 3 can include an electric motor and a fan blade which is connected with the electric motor and driven by the electric motor. The rotatable dual-purpose axial-flow blower/vacuum further includes a handle 2 connected to the main machine housing 1. The handle 2 is designed according to an ergonomic design, which is convenient for an operator to hold. A bottom of the handle 2 is provided with a battery mounting base 4 for mounting a battery pack 5, and the handle 2 is further provided with a switch 9 for controlling start or stop of blowing/suction.

An air suction transition joint 6 is provided on one end of the main machine housing 1 which is an airflow entering. An air blowing portion 7 is provided on the other end of the main machine housing 1, which is the airflow flowing out. A dust accumulation box 13 is detachably connected to the air suction transition joint 6. An air suction portion 15 is detachably connected to the air suction transition joint 6. An air blowing bent pipe 8 is detachably connected to the air blowing portion 7. The air suction transition joint 6 is connected to either the dust accumulation box 13 or the air suction portion 15. A dust filter net 14 is provided in the dust accumulation box 13. The dust filter net 14 is configured to filter inhaled dust and garbage in a dust collection mode. And the air suction portion 15 is configured to block a foreign material from entering the main machine housing 1 with the airflow and avoid damage to the airflow driving device 3 in an air blowing mode.

A rotation structure 1*b* is provided between the main machine housing 1 and the handle 2 and configured to realize a rotation between the main machine housing 1 and the handle 2. Thus, the air blowing mode and the dust collection mode can be switched without changing a direction of the airflow driven by the airflow driving device 3. The rotation structure 1*b* is provided with a rotation locking structure 1*a*, the rotation locking structure 1*a* is configured to lock a circumferential position between the main machine housing 1 and the handle 2, ensuring stability during operation in the air blowing mode or the dust collection mode.

When the rotation locking structure 1*a* is pressed, the rotation structure 1*b* is unlocked. The main machine housing 1 is capable to be rotated to enable the air suction transition joint 6 to face forwards and the air blowing portion 7 to face backward. The dust accumulation box 13 is capable to be mounted to the air suction transition joint 6. The air blowing bent pipe 8 is capable to be mounted to the air blowing portion 7. The axial-flow blower/vacuum is capable to be set in a dust collection mode. Furthermore, the air blowing bent pipe 8 can be rotatable in some directions to avoid blowing out air to the operator in the dust collection mode.

When the rotation locking structure 1*a* is pressed, the rotation structure 1*b* is unlocked. The main machine housing 1 is capable to be rotated to enable the air blowing portion 7 to face forwards and the air suction transition joint 6 to face backward. The air suction portion 15 is capable to be mounted to the air suction transition joint 6, and the axial-flow blower/vacuum is capable to be set in an air blowing mode. Optionally, the air blowing portion 7 is installed an air blowing bent pipe 8 to clean some corners that straight pipes cannot reach.

In some embodiment, the rotation structure 1*b* includes a handle top plate 16 arranged at a top of the handle 2 and a machine housing bottom plate 17 arranged at a bottom of the main machine housing 1. A rotation shaft 18 is arranged in a center of the handle top plate 16. A rotation shaft shoulder 19 is arranged at a tail end of the rotation shaft 18. A rotation shaft sleeve 21 is arranged on the machine housing bottom plate 17 and matched with the rotation shaft 18 to rotate. An inner diameter of the rotation shaft sleeve 21 is greater than an outer diameter of the rotation shaft 18 and less than an outer diameter of the rotation shaft shoulder 19.

In order to limit a rotation angle between the main machine housing 1 and the handle top plate 16 and avoid entangling cables, a limiting boss 20 is arranged on the rotation shaft shoulder 19. At the same time, a first limiting stop block 22 and a second limiting stop block 23 are symmetrically arranged on the rotation shaft sleeve 21 and matched with the limiting boss 20 to limit a maximum rotation angle of the main machine housing 1 to be 180 degrees. When the limiting boss 20 is located at a position of the first limiting stop block 22, the air suction transition joint 6 faces forwards, and the axial-flow blower/vacuum is capable to be set in the dust collection mode. When the limiting boss 20 is located at a position of the second limiting stop block 23, the air blowing portion 7 faces forwards, and the axial-flow blower/vacuum is capable to be set in the air blowing mode.

The rotation locking structure 1*a* includes a rotation locking connection rod 10 and a reset elastic member 12 arranged at a rear of the rotation locking connection rod 10. The rotation locking connection rod 10 is arranged below the handle top plate 16 in a front-back direction of the handle 2. The reset elastic member 12 abuts against an inner surface of the handle 2 backwards. In some embodiments, the reset elastic member 12 is a spring. Two self-locking bosses 11 are arranged at a front position and a rear position of an upper surface of the rotation locking connection rod 10. Two self-locking openings are formed in the handle top plate 16. Two arc-shaped rotating grooves 25 are formed in the machine housing bottom plate 17 by taking the rotating shaft sleeve 21 as a center. The self-locking bosses 11 are clamped into the rotating grooves 25 through the self-locking opening. In order for allowing the operator to unlock the rotation structure 1*b*, a front end of the rotation locking connection rod 10 extends out of a surface of the handle 2.

Furthermore, a self-locking bayonet 24 is arranged at a central position of the rotating groove 25. Under an action of the reset elastic member 12, the self-locking boss 11 is capable to be clamped into the self-locking bayonet 24 to limit a rotation of the main machine housing 1. When the operator presses the rotary locking connecting rod 10, the reset elastic member 12 is compressed, and the self-locking boss 11 is located within the rotating groove 25 and is no longer limited. And the main machine housing 1 can be rotated and a mode of operation can be selected.

In addition to the above preferred implementation exceptions, the present disclosure has other embodiments, and persons skilled in the art may make various changes and transformations according to the present disclosure, as long as it does not deviate from the spirit of the present disclosure, all shall fall within the scope of the claims attached to the present disclosure.

What is claimed is:

1. A rotatable dual-purpose axial-flow blower/vacuum, comprising a main machine housing and an airflow driving device in the main machine housing, wherein an air suction transition joint is provided on one end of the main machine housing, an air blowing portion is provided on the other end of the main machine housing, a dust accumulation box is detachably connected to the air suction transition joint, an air suction portion is detachably connected to the air suction transition joint, an air blowing bent pipe is detachably connected to the air blowing portion, the air suction transition joint is connected to either the dust accumulation box or the air suction portion, a dust filter net is provided in the dust accumulation box, the rotatable dual-purpose axial-flow blower/vacuum further comprises a handle connected to the main machine housing, a bottom of the handle is provided with a battery mounting base for mounting a battery pack, a switch for controlling start or stop of blowing/suction is provided on the handle, a rotation structure is provided between the main machine housing and the handle and configured to realize a rotation between the main machine housing and the handle, the rotation structure is provided with a rotation locking structure, the rotation locking structure is configured to lock a circumferential position between the main machine housing and the handle, when the rotation locking structure is pressed, the main machine housing is capable to be rotated to enable the air suction transition joint to face forwards and the air blowing portion to face backward, the dust accumulation box is capable to be mounted to the air suction transition joint, the air blowing bent pipe is capable to be mounted to the air blowing portion, and the rotatable dual-purpose axial-flow blower/vacuum is capable to be set in a dust collection mode, and when the rotation locking structure is pressed, the main machine housing is capable to be rotated to enable the air blowing portion to face forwards and the air suction transition joint to face backward, the air suction portion is capable to be mounted to the air suction transition joint, and the rotatable dual-purpose axial-flow blower/vacuum is capable to be set in an air blowing mode.

2. The rotatable dual-purpose axial-flow blower/vacuum of claim 1, wherein the rotation structure comprises a handle top plate arranged at a top of the handle and a machine housing bottom plate arranged at a bottom of the main machine housing, a rotation shaft is arranged in a center of the handle top plate, a rotation shaft shoulder is arranged at a tail end of the rotation shaft, a rotation shaft sleeve is arranged on the machine housing bottom plate and matched with the rotation shaft to rotate, and an inner diameter of the rotation shaft sleeve is greater than an outer diameter of the rotation shaft and less than an outer diameter of the rotation shaft shoulder.

3. The rotatable dual-purpose axial-flow blower/vacuum of claim 2, wherein a limiting boss is arranged on the rotation shaft shoulder, a first limiting stop block and a second limiting stop block are symmetrically arranged on the rotation shaft sleeve and matched with the limiting boss to limit a maximum rotation angle of the main machine housing to be 180 degrees, when the limiting boss is located at a position of the first limiting stop block, the air suction transition joint faces forwards, and the axial-flow blower/vacuum is capable to be set in the dust collection mode, when the limiting boss is located at a position of the second limiting stop block, the air blowing portion faces forwards, and the axial-flow blower/vacuum is capable to be set in the air blowing mode.

4. The rotatable dual-purpose axial-flow blower/vacuum of claim 2, wherein the rotation locking structure comprises a rotation locking connection rod and a reset elastic member arranged at a rear of the rotation locking connection rod, the rotation locking connection rod is arranged below the handle top plate in a front-back direction of the handle, two self-locking bosses are arranged at a front position and a rear position of an upper surface of the rotation locking connection rod, two arc-shaped rotating grooves are formed in the machine housing bottom plate by taking the rotating shaft sleeve as a center, and the self-locking bosses are clamped into the rotating grooves, a self-locking bayonet is arranged at a central position of the rotating groove, and under an action of the reset elastic member, the self-locking boss is capable to be clamped into the self-locking bayonet to limit a rotation of the main machine housing.

5. The rotatable dual-purpose axial-flow blower/vacuum of claim 1, wherein the air blowing bent pipe is rotatable.

* * * * *